US012140156B2

(12) United States Patent
Licata

(10) Patent No.: US 12,140,156 B2
(45) Date of Patent: Nov. 12, 2024

(54) PARALLEL FLOW PUMP

(71) Applicant: Electrolux Professional, Inc., Vicksburg, MS (US)

(72) Inventor: Michael P. Licata, Lee's Summit, MO (US)

(73) Assignee: ELECTROLUX PROFESSIONAL, INC., Vicksburg, MS (US)

( * ) Notice: Subject to any disclaimer, the term of this patent is extended or adjusted under 35 U.S.C. 154(b) by 0 days.

(21) Appl. No.: 17/903,673

(22) Filed: Sep. 6, 2022

(65) Prior Publication Data

US 2023/0074178 A1 Mar. 9, 2023

Related U.S. Application Data

(60) Provisional application No. 63/240,968, filed on Sep. 5, 2021.

(51) Int. Cl.

| | |
|---|---|
| ***F04D 29/44*** | (2006.01) |
| ***F04D 1/00*** | (2006.01) |
| ***F04D 29/42*** | (2006.01) |

(52) U.S. Cl.

CPC ..... *F04D 29/448* (2013.01); *F04D 1/00* (2013.01); *F04D 29/426* (2013.01)

(58) Field of Classification Search

CPC .. F04D 29/426; F04D 29/4273; F04D 29/428; F04D 1/00

See application file for complete search history.

(56) References Cited

U.S. PATENT DOCUMENTS

| | | | |
|---|---|---|---|
| 1,491,360 | A | 4/1924 | Reddig |
| 1,959,661 | A | 5/1934 | Ellington et al. |
| 2,278,994 | A | 4/1942 | Kempton |
| 2,475,112 | A | 7/1949 | Stanitz |
| 2,607,628 | A | 8/1952 | Jones |
| 2,651,311 | A | 9/1953 | Rule |
| 2,746,467 | A | 5/1956 | Dempsey et al. |
| 2,884,649 | A | 5/1959 | Alexander |
| 2,980,122 | A | 4/1961 | Fred |
| 3,288,155 | A | 11/1966 | Swetnam |
| D212,305 | S | 9/1968 | Hilleman et al. |
| 3,401,486 | A | 9/1968 | Robert |

(Continued)

FOREIGN PATENT DOCUMENTS

| | | | |
|---|---|---|---|
| AU | 2004308463 | A1 | 7/2005 |
| AU | 2002335694 | B2 | 4/2009 |

(Continued)

OTHER PUBLICATIONS

"Communication pursuant to Article 94(3) EPC received for European Patent Application Serial No. 02770457.6 dated Feb. 25, 2011".

(Continued)

*Primary Examiner* — David E Sosnowski
*Assistant Examiner* — Jackson N Gillenwaters
(74) *Attorney, Agent, or Firm* — Kutak Rock LLP

(57) ABSTRACT

An improved parallel flow pump is provided. The improved parallel flow pump includes clearance for tooling, nuts, and bolts, and further provides smoothed, contoured surfaces and one or more turning vanes to improve the top-to-bottom velocity distribution in the discharge manifold into which the pump flows.

14 Claims, 9 Drawing Sheets

(56) References Cited

U.S. PATENT DOCUMENTS

| | | | | |
|---|---|---|---|---|
| 3,487,478 | A | 1/1970 | Harris | |
| 3,499,388 | A * | 3/1970 | Eberhardt | F04D 29/628 415/196 |
| 3,555,577 | A | 1/1971 | Drain | |
| 3,698,406 | A | 10/1972 | Sato et al. | |
| 3,727,622 | A | 4/1973 | Jacobs | |
| 3,767,118 | A | 10/1973 | Oberto | |
| 3,778,884 | A | 12/1973 | Bene | |
| 3,779,258 | A | 12/1973 | Brenner et al. | |
| 3,826,589 | A | 7/1974 | Frank et al. | |
| 3,909,918 | A | 10/1975 | Takizawa et al. | |
| 3,909,919 | A | 10/1975 | Miyabayashi et al. | |
| 3,935,958 | A | 2/1976 | Frangos | |
| 3,960,290 | A | 6/1976 | Yake et al. | |
| 3,966,363 | A | 6/1976 | Rowley et al. | |
| 4,058,233 | A | 11/1977 | Frangos | |
| 4,192,432 | A | 3/1980 | Jordan | |
| 4,233,083 | A | 11/1980 | Roberts | |
| 4,455,104 | A | 6/1984 | Weisbach | |
| 4,474,198 | A | 10/1984 | Greenfield, Jr. et al. | |
| 4,512,489 | A | 4/1985 | Green et al. | |
| 4,566,970 | A | 1/1986 | Piai et al. | |
| 4,730,630 | A | 3/1988 | Ranft | |
| 4,773,436 | A | 9/1988 | Cantrell et al. | |
| 4,834,125 | A | 5/1989 | Insalaco | |
| 5,069,235 | A | 12/1991 | Vetter et al. | |
| 5,069,360 | A | 12/1991 | Dingler et al. | |
| 5,137,424 | A | 8/1992 | Daniel | |
| 5,287,984 | A | 2/1994 | Michael | |
| 5,431,294 | A | 7/1995 | Stottmann et al. | |
| 5,464,033 | A | 11/1995 | Hartnell | |
| 5,660,194 | A | 8/1997 | Sanders | |
| 5,682,625 | A | 11/1997 | Leaverton et al. | |
| 5,732,724 | A | 3/1998 | Becknell | |
| 5,775,347 | A | 7/1998 | Hoover et al. | |
| 5,810,036 | A | 9/1998 | Hoover et al. | |
| 5,860,172 | A | 1/1999 | Pfeiffer | |
| 5,881,906 | A | 3/1999 | Rogers et al. | |
| 5,927,309 | A | 7/1999 | Hoover et al. | |
| D423,153 | S | 4/2000 | Rastelli | |
| 6,161,718 | A | 12/2000 | Monbo | |
| 6,164,301 | A | 12/2000 | McFadden et al. | |
| 6,528,176 | B1 | 3/2003 | Asai et al. | |
| 6,659,114 | B2 | 12/2003 | Bigott | |
| 6,739,348 | B2 | 5/2004 | Inch et al. | |
| 6,976,496 | B2 | 12/2005 | Cantrell et al. | |
| 7,162,788 | B2 | 1/2007 | Inch et al. | |
| 7,246,624 | B2 | 7/2007 | Cantrell et al. | |
| 7,523,757 | B2 | 4/2009 | Cantrell et al. | |
| 10,213,087 | B2 | 2/2019 | Inch et al. | |
| 10,458,315 | B2 * | 10/2019 | Isogai | F04D 29/624 |
| 10,602,905 | B2 * | 3/2020 | Li | A47L 15/08 |
| 2003/0041886 | A1 | 3/2003 | Cantrell et al. | |
| 2010/0012162 | A1 | 1/2010 | Cantrell et al. | |
| 2010/0135765 | A1 * | 6/2010 | Burgess | F04D 13/12 415/208.1 |
| 2013/0058774 | A1 | 3/2013 | Flückiger et al. | |
| 2014/0271159 | A1 * | 9/2014 | Burgess | F04D 29/4286 415/206 |
| 2016/0053760 | A1 | 2/2016 | Theelen et al. | |
| 2020/0054187 | A1 | 2/2020 | Inch et al. | |
| 2022/0065262 | A1 * | 3/2022 | Ravindranath | F04D 29/426 |

FOREIGN PATENT DOCUMENTS

| | | | | |
|---|---|---|---|---|
| AU | 2004308463 | B2 | 10/2010 | |
| AU | 2009201513 | B2 | 2/2011 | |
| AU | 2011200113 | A1 | 2/2011 | |
| AU | 2011200113 | B2 | 2/2012 | |
| CA | 2459166 | A1 | 3/2003 | |
| CA | 2459204 | A1 | 3/2003 | |
| CA | 2551093 | A1 | 7/2005 | |
| CA | 2459166 | C | 1/2011 | |
| CA | 2459204 | C | 1/2013 | |
| CA | 2551093 | C | 10/2014 | |
| DE | 29709901 | U1 | 8/1997 | |
| EP | 1432533 | B1 | 10/2013 | |
| EP | 3211245 | A1 * | 8/2017 | |
| GB | 2348117 | A | 9/2000 | |
| GB | 2551764 | A * | 1/2018 | F04D 29/4273 |
| JP | 2019-90342 | A | 6/2019 | |
| KR | 10-0657528 | B1 | 12/2006 | |
| KR | 10-2021-0108675 | A | 9/2021 | |
| WO | 2003022465 | A1 | 3/2003 | |

OTHER PUBLICATIONS

"Communication pursuant to Article 94(3) EPC received for European Patent Application Serial No. 02770457.6 dated Nov. 9, 2009".
"Communication pursuant to Article 94(3) EPC received for European Patent Application Serial No. 02770457.6 dated Oct. 26, 2007".
"Communication pursuant to Article 94(3) EPC received for European Patent Application Serial No. 02775739.2 dated Oct. 2, 2009".
"Communication pursuant to Article 94(3) EPC received for European Patent Application Serial No. 02775739.2 dated Sep. 20, 2010".
"Final Office Action received for U.S. Appl. No. 14/792,482, dated Mar. 19, 2018".
"Final Office Action received for U.S. Appl. No. 09/947,485 dated Jul. 31, 2003, 9 pages".
"Final Office Action received for U.S. Appl. No. 12/430,724 dated Aug. 14, 2012, 21 pages".
"First Office Action received for Canadian Application No. 2459166, dated Jul. 8, 2009".
"First Office Action received for Canadian Application No. 2459204, dated Jul. 30, 2009".
"First Office Action received for Canadian Application No. 2551093, dated May 1, 2012".
"Intention to grant received for European Patent Application Serial No. 02770457.6 dated Feb. 21, 2013".
"Intention to grant received for European Patent Application Serial No. 02775739.2 dated Oct. 17, 2011".
"International Preliminary Report received for International Searching Authority, PCT/US02/27950 dated Nov. 28, 2003".
"International Preliminary Report received for International Searching Authority, PCT/US02/27951 dated Feb. 12, 2004".
"International Preliminary Report received for International Searching Authority, PCT/US2004/043368 dated Apr. 3, 2007".
"International Search Report and the Written Opinion of the International Searching Authority, PCT/US02/27950 dated Mar. 26, 2003".
"International Search Report and the Written Opinion of the International Searching Authority, PCT/US02/27951 dated Mar. 26, 2003".
"International Search Report and the Written Opinion of the International Searching Authority, PCT/US2004/043368 dated Mar. 15, 2007".
"Non Final Office Action Received for U.S. Appl. No. 16/283,497 , dated Apr. 2, 2020."
"Non-Final Office Action received for U.S. Appl. No. 09/947,485 dated Mar. 21, 2003, 6 pages".
"Non-Final Office Action received for U.S. Appl. No. 11/775,465 dated Mar. 13, 2008, 10 pages".
"Non-Final Office Action received for U.S. Appl. No. 12/430,724 dated Jan. 6, 2012, 20 pages".
"Non-Final Office Action received for U.S. Appl. No. 12/430,724 dated Jan. 6, 2015, 18 pages".
"Non-Final Office Action Received of U.S. Appl. No. 14/792,482 dated Jun. 2, 2017."
"Notice of Allowance Received for U.S. Appl. No. 14/792,482, dated Oct. 16, 2018, 10 pages".
"Notice of allowance received for U.S. Appl. No. 10/724,486 dated Jun. 22, 2004, 15 pages".
"Notice of allowance received for U.S. Appl. No. 10/744,666 dated Mar. 20, 2007, 11 pages".

(56) References Cited

OTHER PUBLICATIONS

"Notice of allowance received for U.S. Appl. No. 11/775,465 dated Dec. 18, 2008, 16 pages".
"Partial European search report received for European Patent Application Serial No. 02770457.6 dated Feb. 2, 2007".
"Second Office Action received for Canadian Application No. 2459204, dated May 11, 2011".
"Supplementary European Search Report received for European Patent Application Serial No. 02770457.6 dated Apr. 23, 2007".
"Supplementary European Search Report received for European Patent Application Serial No. 02775739.2 dated Oct. 24, 2006".
"Third Office Action received for Canadian Application No. 2459204, dated Dec. 9, 2011".
"Non-Final Office Action received for U.S. Appl. No. 14/792,482, dated Oct. 4, 2016", 8 pages.
"International Search Report and Written Opinion Received for PCT Application No. PCT/US2022/042653, Search completed On Dec. 27, 2022, dated Dec. 28, 2022."

* cited by examiner

PARALLEL FLOW PUMP

CROSS-REFERENCE TO RELATED APPLICATIONS

This application claims priority pursuant to 35 U.S.C. 119(e) to U.S. Provisional Patent Application Ser. No. 63/240,968, filed Sep. 5, 2021, the entire disclosure of which is incorporated herein by reference.

FIELD OF THE INVENTION

The present invention relates generally to pumps. More specifically, the present invention is concerned with parallel flow pumps utilized in commercial washing and other fluid circulating applications.

BACKGROUND

U.S. Pat. No. 6,739,348, filed Sep. 6, 2001, (the "'348 patent") provides a pot and pan washing machine with a wash tank and a self-draining parallel flow pump (in which the intake fluid path of the pump is generally parallel to the discharge fluid path of the pump), the entire disclosure of which is hereby incorporated by reference. The '348 patent further provides a self-cleaning intake manifold within the wash tank, flush mounted jet nozzles within the wash tank, and a non-welded field joint for connecting two portions of the washing machine together as a single unit. The pump is located on a side of the wash tank. Fluid enters the pump in a first direction and is discharged in a second direction that is substantially parallel to the first direction.

The parallel flow pump of the '348 patent is depicted both externally and internally in FIGS. 1-7 and provides a superior flow of fluid to the wash tank, thereby facilitating a superior washing action within the tank. While this pump is highly efficient over prior pumps, there have been increased demands for greater efficiency, particularly in commercial environments such as restaurants and commercial kitchens.

For example, the parallel flow pump of the prior art includes a multitude of sharp corners inside of the pump, which reduce efficiency and potentially limits the flow of the pump (referred to herein as "flow restrictors"). This results in capped pumping capacity which, in turn, results in a salesman's inability to quote larger versions of the machines. There are two such locations inside the pump as illustrated in FIGS. 3-5 and FIGS. 6-7.

FIGS. 3-5 demonstrate a first location of sharp corner associated with the pump and/or volute. An arrow is depicted as pointing to a flat-faced, sharp-cornered obstruction at a location in the flow path which has a deleterious effect on pump efficiency and maximum flow capacity. A lower arrow is depicted as showing the flow path of a fluid within the pump.

FIGS. 6-7 demonstrate a second location of a sharp corner associated with the pump and/or volute. An upper arrow is depicted as pointing to a sharp corner on a circular opening in the flow path which has a significantly negative effect on pump efficiency and maximum flow capacity. A lower arrow is depicted as showing the flow path of a fluid within the pump.

Accordingly, it would be advantageous to provide a parallel flow pump structure(s) to provide such greater efficiency.

Moreover, the ability to rapidly assemble mass-produced machinery has a direct and significant effect on the profitability of a manufacturing operation. The design of the parallel flow pump of the '348 patent, while expertly manufactured and designed, is difficult to attach the pump to the various wash sinks of various product lines. Manually operated, open-end wrenches are required to attach the volutes to the wash sinks resulting in an extremely tedious and time-consuming process. Accordingly, it would be advantageous to provide a pump design which accounts for socket wrench clearances and/or that is subsequently considerably easier to assemble to the associated machine.

SUMMARY

The present invention comprises an improved parallel flow pump (in which the intake fluid path of the pump is generally parallel to the discharge fluid path of the pump) that provides increased efficiency and/or easier installation compared to those of the prior art.

FIGS. 8-13 depict an improved parallel flow pump of the inventive concept that improves upon the efficiency of the prior art and that is easier to install. As shown in FIG. 8, the improved pump includes socket wrench clearance for one or all fastener holes to allow rapid assembly of the volute to a wash sink. In some embodiments all clearance features allow a 0.75 inch diameter socket to operate on the 5/16 inch hex nuts used to secure the volute to the wash sink, and it will be appreciated that clearances for other socket and hex nut sizes are within the scope of various embodiments of the inventive concept.

Additionally, in the pump of FIGS. 8-13 the two internal flow restrictors of the prior art have been significantly improved. Referring to FIGS. 9-11, the blunt face depicted in FIGS. 3-5 has been replaced by and improved by a gently angled surface. One or more corners are radiused for minimal flow resistance.

Referring to FIGS. 12-13, the sharp corner depicted in FIGS. 6-7 has been replaced by a generous radius to minimize the flow resistance.

Referring to FIGS. 14-15, in some embodiments, one or more turning vanes at the discharge are provided. The turning vanes purpose is to improve the top-to-bottom velocity distribution in the discharge manifold into which the pump flows. The velocity profile of the prior art, which is heavy at the top of the volute discharge, contributes to uneven flow along the length of the discharge manifold. It will be appreciated that the number, position, and size of the vanes in various embodiments are configurable to the needs of a particular application.

The foregoing and other objects are intended to be illustrative of the invention and are not meant in a limiting sense. Many possible embodiments of the invention may be made and will be readily evident upon a study of the following specification and accompanying drawings comprising a part thereof. Various features and subcombinations of invention may be employed without reference to other features and subcombinations. Other objects and advantages of this invention will become apparent from the following description taken in connection with the accompanying drawings, wherein is set forth by way of illustration and example, an embodiment of this invention and various features thereof.

BRIEF DESCRIPTION OF THE DRAWINGS

A preferred embodiment of the invention, illustrative of the best mode in which the applicant has contemplated applying the principles, is set forth in the following description and is shown in the drawings and is particularly and distinctly pointed out and set forth in the appended claims.

DETAILED DESCRIPTION

Figure 1:
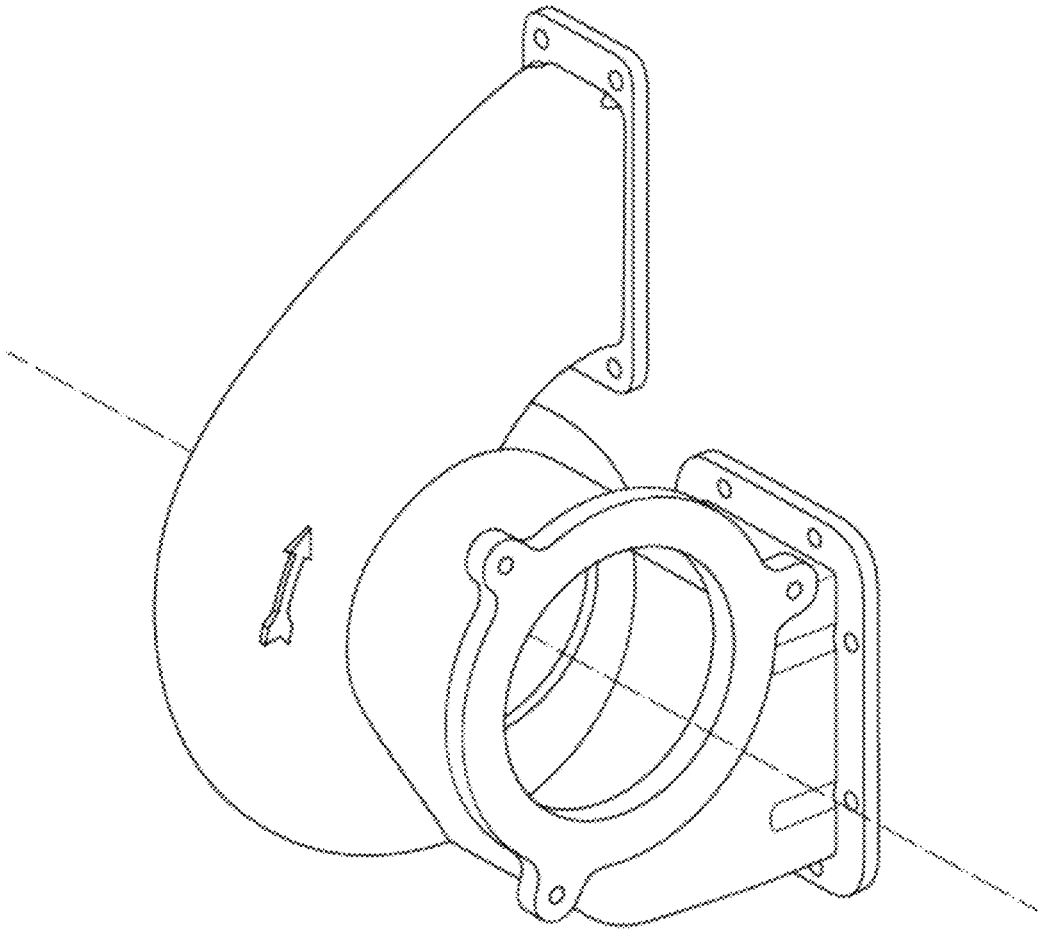
FIG. 1 is a perspective view of a flow pump of the prior art.
Figure 2:
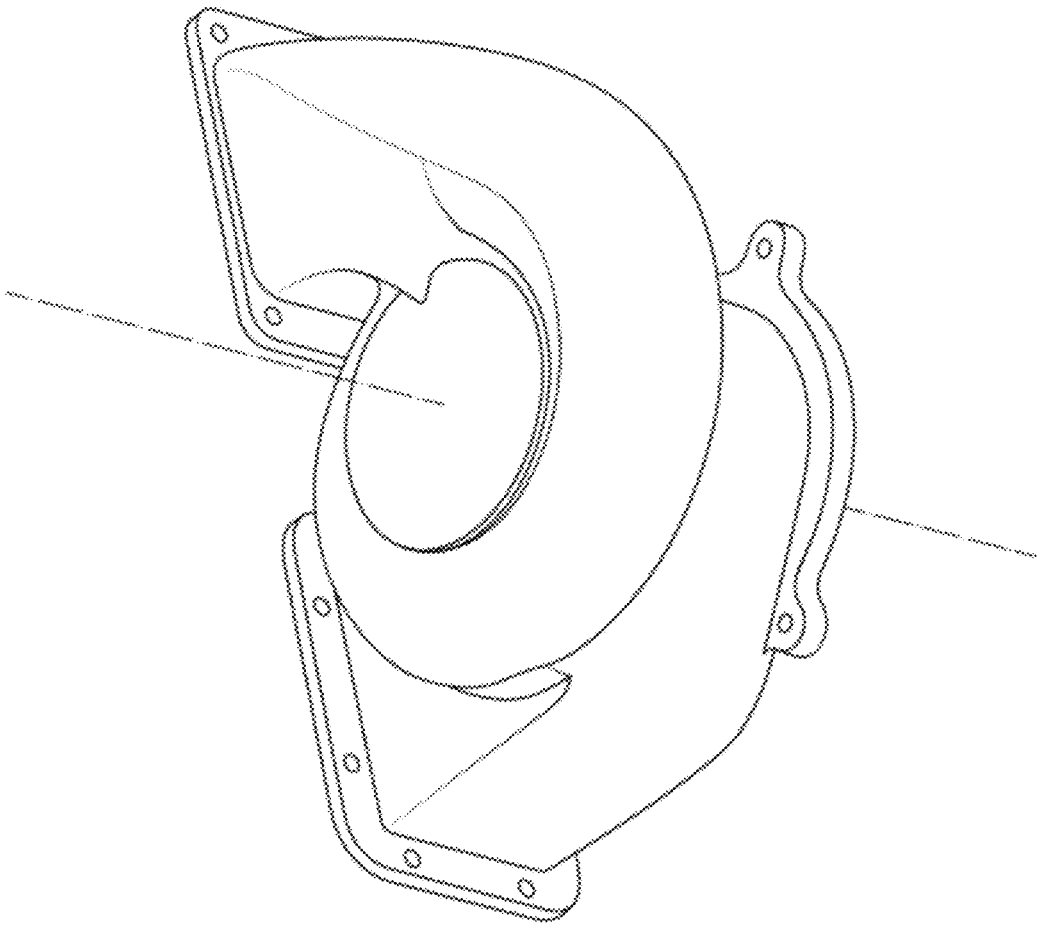
FIG. 2 is a perspective view of the flow pump of FIG. 1.
Figure 3:
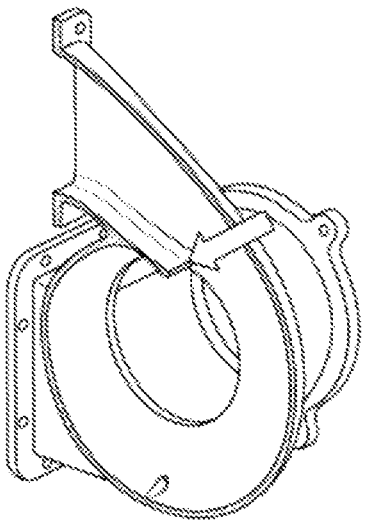
FIG. 3 is a sectional perspective view of the flow pump of FIG. 1, showing the location of a first sharp corner.
Figure 4:
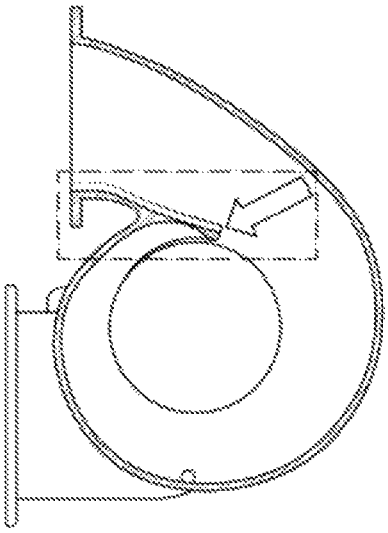
FIG. 4 is a sectional side view of the flow pump of FIG. 1, showing the location of a first sharp corner.
Figure 5:
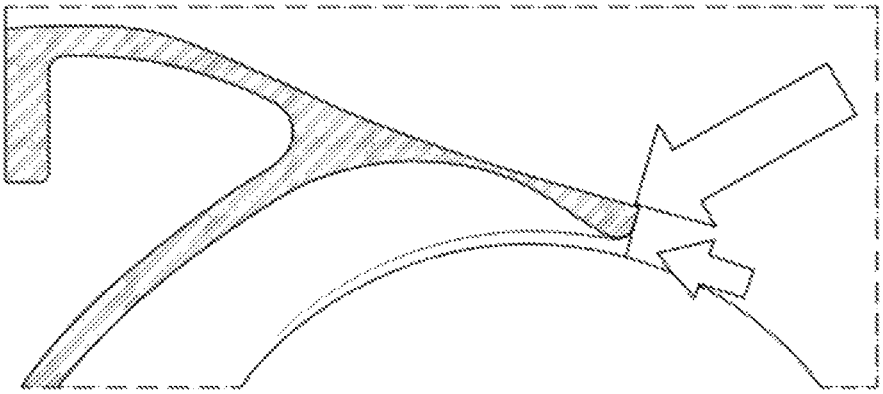
FIG. 5 is an enlarged view of the location of the first sharp corner depicted in FIG. 4.
Figure 6:
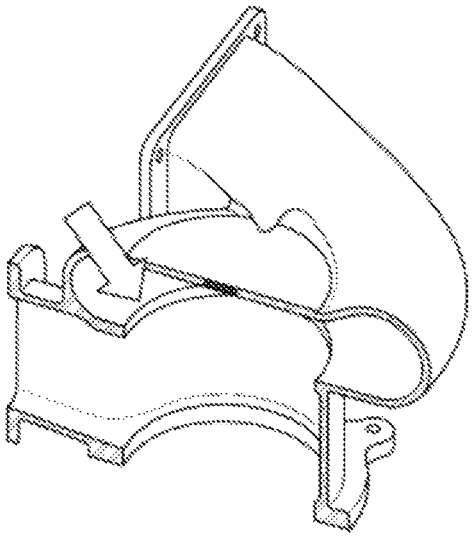
FIG. 6 is a sectional perspective view of the flow pump of FIG. 1, showing the location of a second sharp corner.
Figure 7:
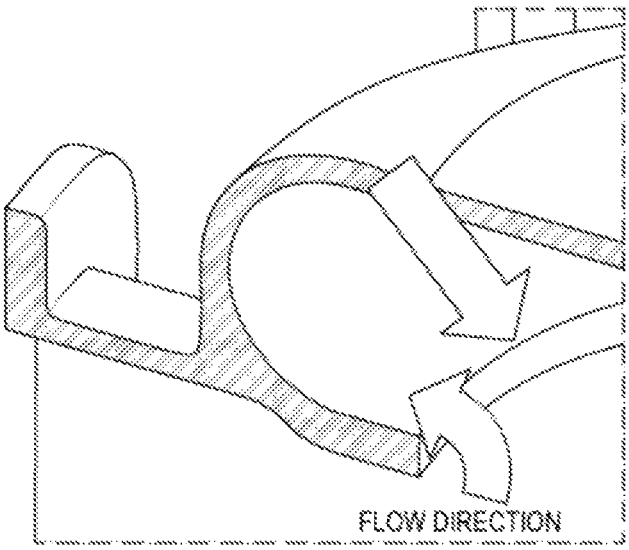
FIG. 7 is an enlarged view of the location of the second sharp corner as depicted in FIG. 6.

As required, a detailed embodiment of the present invention is disclosed herein; however, it is to be understood that the disclosed embodiment is merely exemplary of the principles of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring to FIGS. 8-15, the present invention discloses an improved parallel flow pump 150. In the depicted embodiment, the improved parallel flow pump 150 provides a superior flow of a fluid through the pump. In the depicted embodiment, the improved parallel flow pump 150 increases efficiency of a fluid path by resolving the amount of diversion and resistance of the fluid path within the improved parallel flow pump 150. Moreover, the improved parallel flow pump 150 of the instant invention, moves a fluid by means of the transfer of rotational energy from one or more driven rotors, such as an impeller.

In the depicted embodiment, the improved parallel flow pump 150 includes a pump housing 155. In some embodiments of the present invention, the pump housing 155 is a generally helical housing. In the depicted embodiment of the improved parallel flow pump 150, the pump housing defines a generally helical housing; however other housing configurations or shapes are contemplated in various other embodiments of the inventive concept.

In some embodiments of the instant invention, the improved parallel flow pump 150 includes an intake chamber 192. In some embodiments, the housing 155 of the improved parallel flow pump 150 defines the intake chamber 192. In some embodiments of the present invention, the intake chamber 192 extends from a pump inlet 152 to a raised volute 194. In some embodiments of the instant invention, the intake chamber 192 extends from a pump inlet 52 to a cylindrical passage 190.

Figure 8:
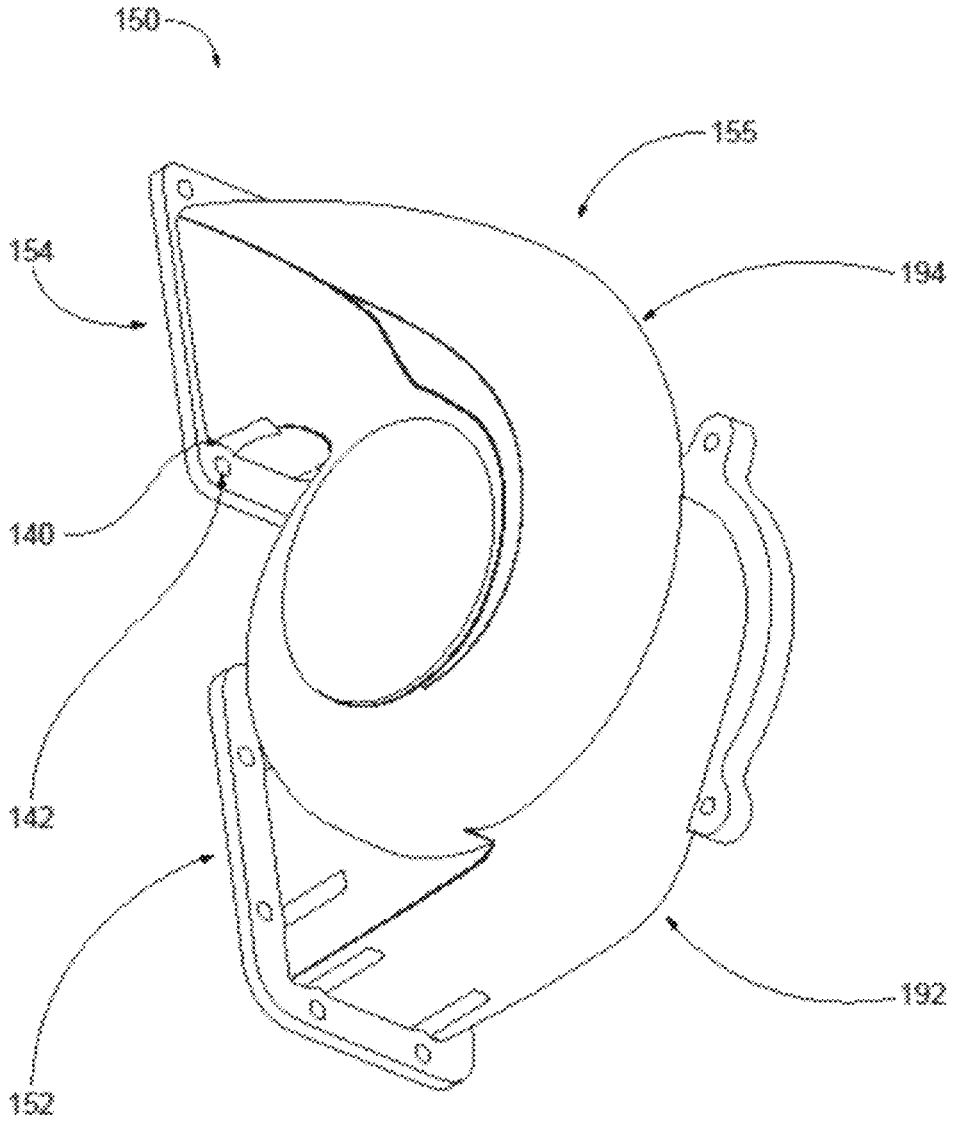
FIG. 8 is a perspective view of an improved parallel flow pump according to some embodiments of the present invention.

In some embodiments of the instant invention, the improved parallel flow pump 150 includes a raised volute 194. In some embodiments, the housing 155 of the improved parallel flow pump 150 defines the raised volute 194. As shown in FIG. 8, in some embodiments the raised volute 194 is in an axially raised position relative to the intake chamber 192. In some embodiments of the present invention, the raised volute 194 extends from a pump outlet 154 to the intake chamber 192. In some embodiments, the raised volute 194 extends from a pump outlet 154 to a cylindrical passage 190.

In some embodiments of the instant invention, the improved parallel flow pump includes a cylindrical passage 190. In some embodiments, the housing 155 of the improved parallel flow pump 150 defines the cylindrical passage 190. As shown in FIG. 8, the cylindrical passage 190 extends axially through the intake chamber 192 and the raised volute 194. In some embodiments of the present invention, a motor assembly is connected to the pump housing 155.

In some embodiments, the improved parallel flow pump 150 is removably attached to a pump motor assembly. In some embodiments of the instant invention, the pump motor assembly protrudes axially from the pump housing 155. In some embodiments, a motor assembly is inserted into the cylindrical passage 190. In some embodiments of the instant invention, the motor assembly includes an impeller and impeller assembly. In some embodiments, the motor assembly is inserted, impeller first, into the cylindrical passage 190. In some embodiments, the impeller extends into the raised volute 194.

In some embodiments of the instant invention, the improved parallel flow pump 150 includes a drainage passage 196. In some embodiments, the housing 155 of the improved parallel flow pump 150 defines the drainage passage 196. In some embodiments, the drain passage extends from the lower portion of the raised volute 194 into intake chamber 192. In some embodiments of the present invention, when the pump motor is not operating, gravitational forces will cause some or all fluid within the raised volute 194 through the drainage passage 196, into the intake chamber 192.

In some embodiments, the improved parallel flow pump 150 includes a pump inlet 152 and a pump outlet 154. In some embodiments of the present invention, a direction of the pump inlet 152 is generally parallel to a direction of the pump outlet 154. In some embodiments, the pump inlet 152 is removably attached to an intake port of a pot and pan washing machine, produce washing machine, and/or other basin. In some embodiments, the pump outlet 154 is removably attached to an outlet manifold of a pot and pan washing machine, produce washing machine, and/or other basin. In some embodiments, the pump inlet 152 or the pump outlet 154 comprises a generally square or rectangle cross-section; however, the pump inlet 152 or pump outlet 154 in other various embodiments comprise a cross-section of virtually any shape.

In operation, the motor assembly rotates the impeller inside the pump housing 155 causing a fluid to flow in a first fluid path. The impeller has an enclosed face which results in a suction for the impeller flowing from the shaft side of the impeller. Fluid is drawn into the pump inlet 152, then into the intake chamber 192 from the shaft side of the impeller. The impeller creates a rotational movement of the fluid within the intake chamber 192. An anti-rotational member directs the rotating fluid within the intake chamber 192 from the chamber into the raised volute 194. The fluid is thrust into the raised volute 194 through vanes of the rotating impeller. The raised volute 194 then directs the fluid outward where it is discharged into the pump outlet 154.

In some embodiments of the instant invention, the pump housing 155 defines the first fluid path, which extends from the pump inlet 152 to the pump outlet 154. In the embodiment shown, the first fluid path starts in first direction from the intake, rotates generally 180 degrees by a first volute portion along a first plane that is parallel to the intake direction, and then is turned in a direction that is generally perpendicular to the first plane of rotation to move from the first volute portion to a second volute portion. In the second volute portion, the first fluid path is turned generally perpendicularly into a direction that is generally parallel to the first plane of rotation. The first fluid path is rotated through the second volute portion generally 180 degrees about a second plane of rotation that is parallel to the first plane of rotation, and the fluid path ends at the pump discharge. In the depicted embodiment, the improved parallel flow pump 150 defines an improved fluid path. In some embodiments, the improved fluid path comprises a plurality of improved fluid paths. In some embodiments of the instant invention, a fluid is drawn into the pump inlet 152 in a first direction. In another embodiment, fluid is discharged from the pump outlet 154 in a second direction. In some embodiments, the first direction is generally parallel to the second direction. In some embodiments of the instant invention the first fluid path begins when a fluid is drawn into the pump inlet 152, next the fluid enters into and passes through the intake chamber 192, next the fluid enters into and passes through the cylindrical passage 190, next the fluid enters into and passes though the raised volute 194, finally the fluid exits the improved parallel flow pump 150 though the pump outlet 152.

In some embodiments, the pump housing 155 is constructed entirely of a first material. In other embodiments, the pump housing 155 is constructed from a plurality of materials. In some embodiments of the instant invention, the improved parallel flow pump 150 is constructed entirely stainless steel; however, it will be appreciated that other embodiments of the inventive concept are constructed of any suitable material for the application.

Referring again to FIGS. 8-15, the disclosed embodiment includes an improved parallel flow pump 150. In an exemplary embodiment, the improved parallel flow pump 150 includes a plurality of improved flow restrictors 170, the improved flow restrictors 170 being configured to advance the efficiency of the improved parallel flow pump. In some exemplary embodiments, the improved parallel flow pump 150 comprises one or more structural clearances 140 for one or all fastener holes 142 positioned along mounting flanges that are generally parallel to the pump housing at the inlet and outlet, the clearances 140 being configured to allow rapid assembly of the volute to a wash sink. In some embodiments, the clearances 140 comprise notched or otherwise indented areas in the surface of the pump housing. In some other exemplary embodiments, the improved parallel flow pump 150 includes one or more turning vanes 130, the one or more turning vanes 130 being configured to improve the velocity distribution in the discharge manifold into which the improved parallel flow pump 150 flows.

The interaction with objects, such as restrictors or objects, placed within, or in contact with, a fluid path often influences the efficiency of a pump and, thus, limiting the pumping capacity of a parallel flow pump. In a preferred embodiment of the present invention, the improved parallel flow pump 150 replaces one or more objects or restrictors with one or more improved flow restrictors 170, such as a flow advancer 170 (the terms improved flow restrictor and flow advancer are used interchangeably herein).

Referring to FIGS. 9-13, a perspective view of the plurality of improved flow restrictors 170 are depicted. In preferred embodiment of the instant invention, the plurality of improved flow restrictors 170 includes one or more angled surface 172 and one or more rounded corner 174. In some embodiments, the plurality of improved flow restrictors 170 includes one or more angled surface 172 or one or more rounded corner 174. In some embodiments of the instant invention, the improved flow restrictor 170 includes a gently angled surface. In some embodiments, the improved flow restrictor 170 includes a gently angled surface, such that the gently angled surface decreases the angle between two outer intersecting surfaces of a restriction. In some embodiments, the improved flow restrictor 170 comprises a gently angled surface, such that the rounded surface increases the angle between two inner intersecting surfaces of a restriction In some embodiments, the improved flow restrictor 170 includes a plurality of flow restriction reducing surfaces. In some embodiments of the instant invention, the plurality of flow restriction reducing surfaces are machined surfaces. In some embodiments of the present invention, the improved flow restrictor 170 comprises a rounded surface, such that the rounded surface decreases the angle A1 between two outer intersecting surfaces 175 of a restriction. In some embodiments, the improved flow restrictor 170 comprises a rounded surface, such that the rounded surface increases the angle A2 between two inner intersecting surfaces 176 of a restriction. In some embodiments of the instant invention, the improved flow restrictor includes a plurality of surface round edges. In some embodiments, the improved flow restrictor 170 includes a plurality of chamfered edges. In some embodiments of the instant invention, flow restriction reducing surface comprises two or more surfaces that the angel or inclination of the two surfaces meet one another at any angle other than a right angle.

Figure 9:
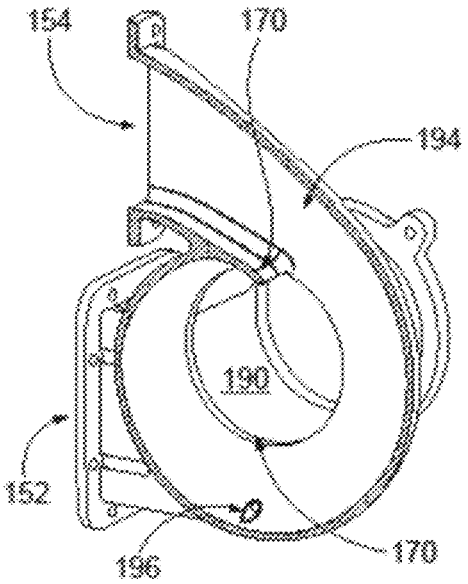
FIG. 9 is a sectional perspective view of the flow pump of FIG. 8, showing the location of a first improved corner.
Figure 10:
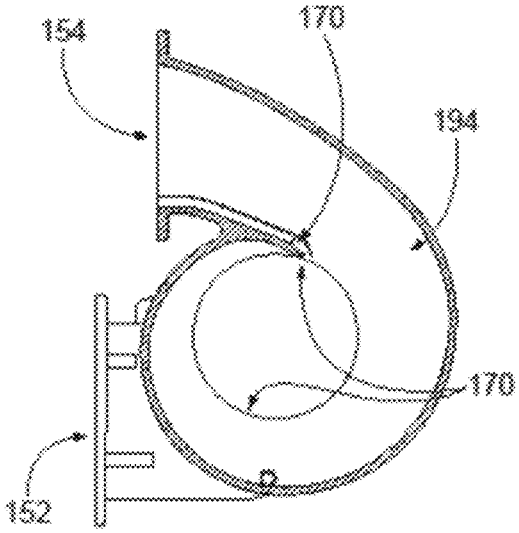
FIG. 10 is a sectional side view of the flow pump of FIG. 8, showing the location of a first improved corner.
Figure 11:
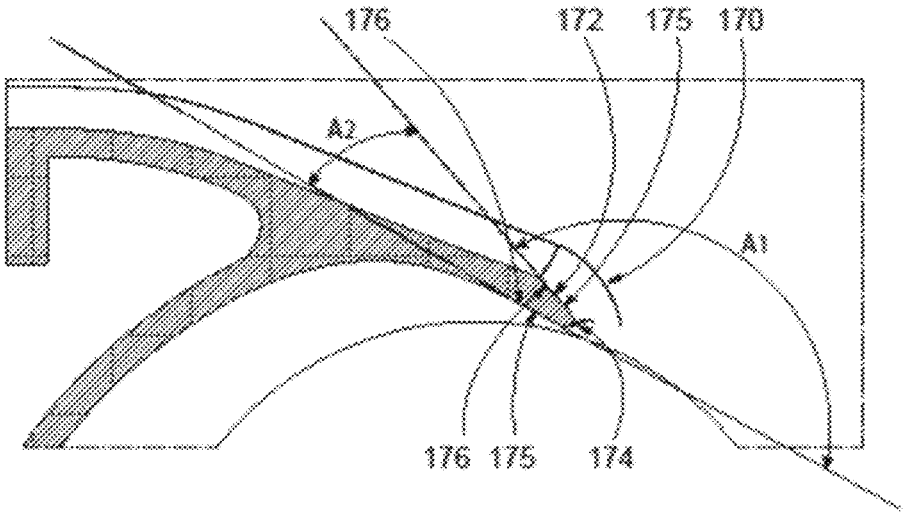
FIG. 11 is an enlarged view of the location of the first improved corner depicted in FIG. 10.
Figure 12:
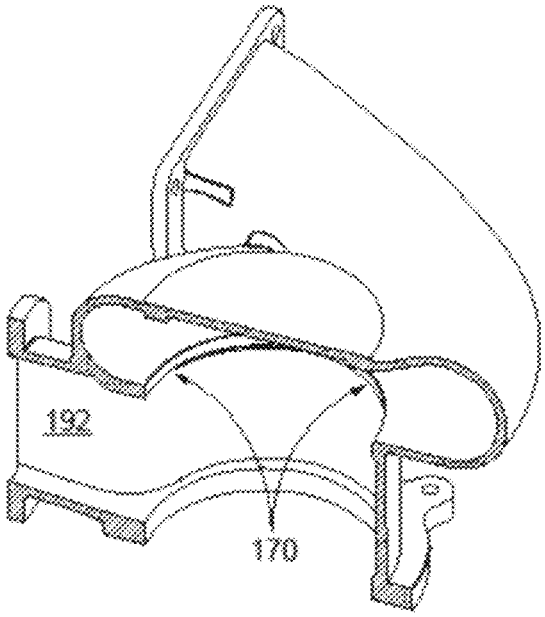
FIG. 12 is a sectional perspective view of the flow pump of FIG. 8, showing the location of a second improved corner.
Figure 13:
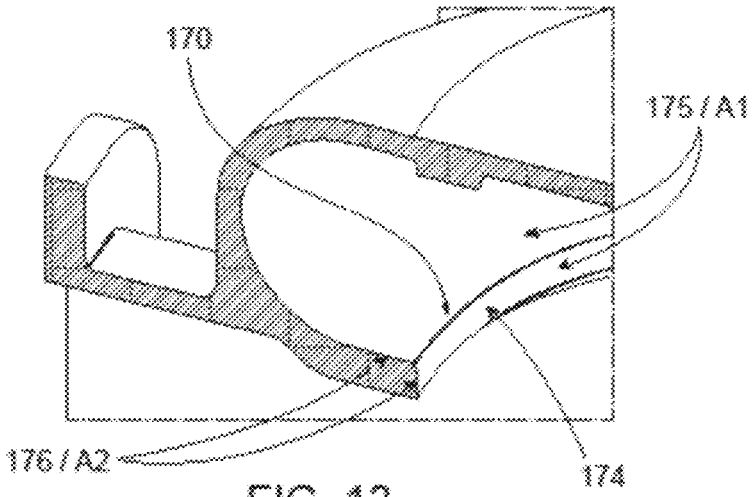
FIG. 13 is an enlarged view of the location of the second improved corner as depicted in FIG. 12.

In some embodiments of the instant invention, as shown in FIGS. 12 and 13, the improved flow restrictors are positioned along surfaces within the pump, wherein the surface includes a circular shape. In some embodiments, as shown in FIGS. 9-11, the improved flow restrictors are position along one or more surface, wherein the surface includes a mostly horizontal or mostly vertical shape. In some embodiments of the present invention, the improved flow restrictors are positioned on surfaces other than circular, horizontal, or vertical.

In a preferred embodiment of the instant invention, the improved flow restrictors 170 increase the fluid velocity along a fluid path within the pump housing 155. In another preferred embodiment of the instant invention, the improved flow restrictors 170 increase the efficiency of the improved parallel flow pump 150.

Again, referring to FIGS. 12-13, a flow advancer 170 is depicted. The flow advancer 170 is disposed between the intake chamber 192 and the cylindrical passage 190. As fluid passes from the intake chamber 192 into and along the cylindrical passage 190, the flow advancer reduces the flow resistance, thus resulting in an increase in the overall efficiency of the improved parallel flow pump 150. Referring again to FIGS. 9-11, another flow advancer is depicted. The flow advancer in FIGS. 9-11 is positioned such that flow resistance is decreased as a fluid passes from the cylindrical passage 190 into the raised volute 194. As with the previous flow advancer depicted in FIGS. 12-13, this flow advancer also reduces the flow resistance, thus resulting in an increase in the overall efficiency of the improved parallel flow pump 150

Figure 14:
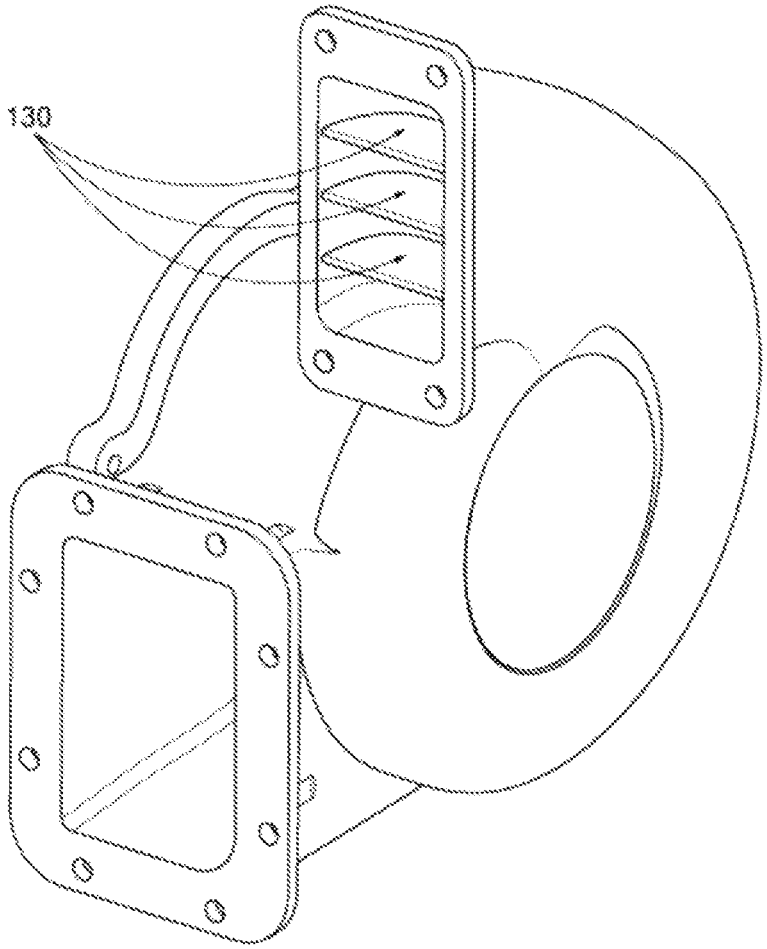
FIG. 14 is a perspective view of an improved parallel flow pump according to some embodiments of the present invention.
Figure 15:
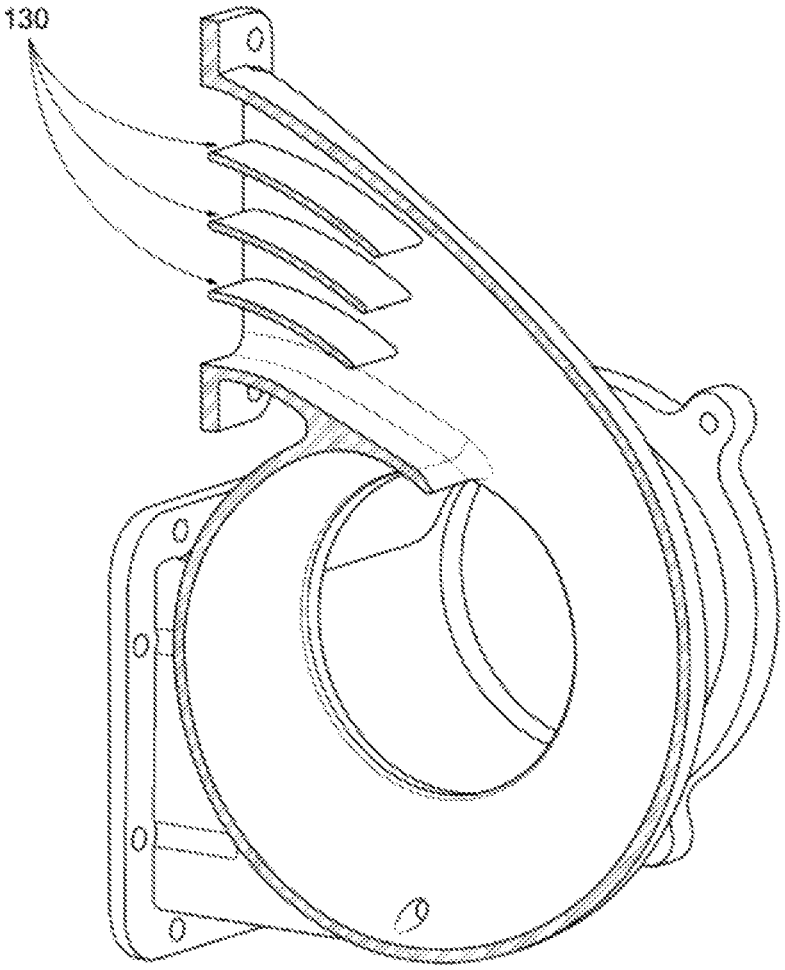
FIG. 15 is a sectional perspective view of the flow pump of FIG. 14.

Referring to FIGS. 14-15, the one or more turning vanes 130 are shown. In a preferred embodiment of the improved parallel flow pump 150, the one or more turning vanes 130 improve the top-to-bottom fluid velocity distribution at the pump outlet 154. In another preferred embodiment of the instant invention, the one or more turning vanes 130 reduce the fluid turbulence at the pump outlet 154. While the drawings portray the one or more fluid flow turning vanes 130 for use within the raised volute 194 of the improved parallel flow pump 150, various embodiments of the present invention also include the one or more turning vanes 130 being used in other areas of the improved parallel flow pump 150. In some embodiments, a first turning vane 130 comprise the same overall shape as a second turning vane 130. In some embodiments of the instant invention, the first turning vane 130 includes a differing overall shape than the second turning vane 130. In other various embodiments of the instant invention, that the overall shape of each turning vane 130 is designed in such a way to accommodate the requirements of any pump housing.

Referring to FIG. 14, a perspective view of the one or more turning vanes 130 is shown. While this view depicts a configuration comprising three turning vanes 130, other configurations are contemplated by various other embodiments of the instant invention. In the illustrated configuration, the one or more turning vanes 130, extend from the raised volute 194 portion of the improved parallel flow pump 150 to the pump outlet 154. In some embodiments of the instant invention, the one or more turning vanes 130 extend from a first side wall of the interior of the pump housing 155 to a second interior side wall of the pump housing 155.

Referring to FIG. 15, one embodiment depicting a configuration of the one or more turning vanes 130, being placed within the raised volute 194 of the improved parallel flow pump 150 is shown. In some embodiments, each turning vane 130 comprises an overall curved cross-sectional profile, such that the one or more turning vanes 130 extend from the raised volute 194 of the improved parallel flow pump 150 to the pump outlet 154. In one embodiment of the instant invention, each turning vane 130 comprises an elongated body that includes one end being disposed in, or near, the raised volute 194 and another end being disposed at, or near, the pump outlet 154. In some embodiments, the end being disposed within in, or near, the raised volute 194 is a leading edge. In another embodiment of the instant invention, the end being disposed at, or near, the pump outlet 154 is a trailing end. In some embodiments of the instant invention, one or more turning vane 130 include one or more improved flow restrictor 170. In some embodiments, the first end of the one or more turning vanes 130 include one or more improved flow restrictor 170. In another embodiment of the present invention, the second end of the one or more turning vanes 130 include one or more improved flow restrictor 170. Yet in another embodiment, the first and the send end of the one or more turning vanes 130 include one or more improved flow restrictor 170.

The improved parallel flow pump of the instant invention is designed in such a way such that the improved parallel flow pump is capable of being mounted to a surface, such as a wash sink of a pot and pan washing machine. In one embodiment of the instant invention, the improved parallel flow pump includes one or more fastener holes 142 for mounting the pump 150 to the surface. In a preferred embodiment of the present invention, the improved parallel flow pump incorporates a design that comprises an improved clearance 140 for the one or more fastener holes 142. This improved clearance provides additional socket and wrench clearance for one, or all, fastener holes 142 to allow for rapid assembly of the improved parallel flow pump 150 to the surface. Referring to FIG. 8, one or more improved clearances 140 are shown as generally rounded grooves or channels within the surface of the housing. In the embodiment shown the clearances 140 are generally sized and shaped to accommodate the outer surface of a socket. In some embodiments, the improved clearance is configured for a 0.75 inch diameter socket, or tool, to operate on a fastener, such as a 5/16 inch hex nut, used to secure the raised volute 194 to the surface, and it will be appreciated that clearances for other tools and fasteners are contemplated in other embodiments of the inventive concept.

In the foregoing description, certain terms have been used for brevity, clearness and understanding; but no unnecessary limitations are to be implied therefrom beyond the requirements of the prior art, because such terms are used for descriptive purposes and are intended to be broadly construed. Moreover, the description and illustration of the inventions is by way of example, and the scope of the inventions is not limited to the exact details shown or described.

Although the foregoing detailed description of the present invention has been described by reference to an exemplary embodiment, and the best mode contemplated for carrying out the present invention has been shown and described, it will be understood that certain changes, modification or variations may be made in embodying the above invention, and in the construction thereof, other than those specifically set forth herein, may be achieved by those skilled in the art without departing from the spirit and scope of the invention, and that such changes, modification or variations are to be considered as being within the overall scope of the present invention. Therefore, it is contemplated to cover the present invention and any and all changes, modifications, variations, or equivalents that fall with in the true spirit and scope of the underlying principles disclosed and claimed herein. Consequently, the scope of the present invention is intended to be limited only by the attached claims, all matter contained in the above description and shown in the accompanying drawings shall be interpreted as illustrative and not in a limiting sense.

Having now described the features, discoveries and principles of the invention, the manner in which the invention is constructed and used, the characteristics of the construction, and advantageous, new and useful results obtained; the new and useful structures, devices, elements, arrangements, parts and combinations, are set forth in the appended claims.

It is also to be understood that the following claims are intended to cover all of the generic and specific features of the invention herein described, and all statements of the scope of the invention which, as a matter of language, might be said to fall therebetween.

What is claimed is:

1. An improved flow parallel flow pump comprising:

a helical pump housing, wherein the helical pump housing is axially displaced around an axis, the axis being perpendicular to a first plane;

a pump inlet, wherein the pump inlet is positioned at a first end of the helical pump housing, and wherein the pump inlet is positioned parallel to the first plane;

a pump outlet, wherein the pump outlet is positioned at a second end of the helical pump housing, wherein the pump outlet is in a raised position relative to the pump inlet, and wherein the pump outlet is positioned parallel to the first plane;

a first fluid path, wherein the first fluid path extends from the pump inlet to the pump outlet, wherein a fluid enters the pump inlet in a first direction and is discharged from the pump outlet in a second direction, and wherein the first direction is parallel to the second direction; and a plurality of flow advancers within the first fluid path.

2. The improved flow parallel flow pump as claimed in claim 1, wherein each flow advancer comprises a first flow restriction reducing surface.

3. The improved flow parallel flow pump as claimed in claim 2, wherein the first flow restriction reducing surface is configured to minimize a flow resistance of the first fluid path.

4. The improved flow parallel flow pump as claimed in claim 2, wherein the first flow restriction reducing surface of a first flow advancer comprises:

a first surface; and a second surface, wherein the first surface and the second surface comprise an intersecting point, wherein the first surface and the second surface are displaced by an inside angle, and wherein the first surface and the second surface are displaced by an outside angle.

5. The improved flow parallel flow pump as claimed in claim 4, wherein the inside angle includes a degree of less than ninety degrees between the first surface and the second surface, wherein the inside angle extends from a lower surface of the first surface to an upper surface of the second surface.

6. The improved flow parallel flow pump as claimed in claim 4, wherein the outside angle includes a degree of more than two-hundred seventy degrees between the first surface and the second surface, wherein the outside angle extends from an upper surface of the first surface to a lower surface of the second surface.

7. The improved flow parallel flow pump of claim 4, wherein the first flow advancer is positioned within an interior area of a raised volute.

8. The improved flow parallel flow pump of claim 7, wherein an intake fluid path of the pump is generally parallel to discharge fluid path, and wherein the first flow advancer is positioned perpendicular to the discharge fluid path within an interior area of the raised volute.

9. The improved flow parallel flow pump of claim 1 wherein:

the pump inlet is fixedly attached to a first end of the helical pump housing, and wherein the pump outlet is fixedly attached to a second end of the helical pump housing;

an intake chamber extends from the pump inlet to a cylindrical passage, the cylindrical passage extending from the intake chamber to a raised volute, and the raised volute extending from the cylindrical passage to the pump outlet.

10. The improved flow parallel flow pump of claim 9, wherein a second flow advancer is positioned between the intake chamber and the raised volute.

11. The improved flow parallel flow pump of claim 10, wherein the second flow advancer comprises helical structure that includes a rounded surface.

12. The improved flow parallel flow pump of claim 11, wherein the second flow advancer is positioned parallel to the cylindrical passage.

13. The improved flow parallel flow pump of claim 9, wherein the raised volute is in an axially raised position relative to the intake chamber.

14. The improved flow parallel flow pump of claim 9, wherein the cylindrical passage extends axially through the intake chamber and the raised volute.

* * * * *